US010913562B2

(12) United States Patent
Gabler et al.

(10) Patent No.: US 10,913,562 B2
(45) Date of Patent: Feb. 9, 2021

(54) TRAY SEALER

(71) Applicant: MULTIVAC Sepp Haggenmüller SE & Co. KG, Wolfertschwenden (DE)

(72) Inventors: Albert Gabler, Lachen-Albishofen (DE); Andreas Mader, Dietmannsried (DE); Thomas Zedelmaier, Böhen (DE); Luciano Capriotti, Bad Grönenbach (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 327 days.

(21) Appl. No.: 15/832,685

(22) Filed: Dec. 5, 2017

(65) Prior Publication Data

US 2018/0155074 A1 Jun. 7, 2018

(30) Foreign Application Priority Data

Dec. 6, 2016 (DE) ..... 10 2016 123 569

(51) Int. Cl.

| | |
|---|---|
| ***B65B 53/06*** | (2006.01) |
| ***B65B 47/02*** | (2006.01) |
| ***B65B 7/16*** | (2006.01) |
| ***B65B 31/02*** | (2006.01) |
| ***B65B 31/04*** | (2006.01) |
| ***B65B 25/00*** | (2006.01) |

(Continued)

(52) U.S. Cl.

CPC ..... *B65B 53/06* (2013.01); *B65B 7/164* (2013.01); *B65B 9/04* (2013.01); *B65B 11/52* (2013.01); *B65B 25/001* (2013.01); *B65B 31/02* (2013.01); *B65B 31/028* (2013.01); *B65B 31/04* (2013.01); *B65B 47/02* (2013.01)

(58) Field of Classification Search

CPC ..... B65B 7/164; B65B 31/025; B65B 31/028; B65B 47/02; B65B 47/10; B65B 25/001; B65B 11/52; B65B 9/04; B31B 50/592; B29C 51/421; B29C 51/424; B29C 51/425; B29C 51/428

USPC ..... 53/478, 290, 296, 427, 509

See application file for complete search history.

(56) References Cited

U.S. PATENT DOCUMENTS 3,258,813 A * 7/1966 Groth ..... B29C 51/424 425/526
3,481,100 A * 12/1969 Bergstrom ..... B65B 31/021 53/433

(Continued)

FOREIGN PATENT DOCUMENTS

CN 102803077 A 11/2012
CN 203601616 U 5/2014

(Continued)

*Primary Examiner* — Stephen F. Gerrity
*Assistant Examiner* — Joshua G Kotis
(74) *Attorney, Agent, or Firm* — Husch Blackwell LLP

(57) ABSTRACT

A tray sealer including a sealing station comprising a tool upper part, a clamping frame and a tool lower part. The tool upper part may surround a dome-shaped die used for deforming a skinnable top film. First and second channels in the dome-shaped die and in the tool upper part, respectively, are connectable to one another. The tool upper part or the dome-shaped die may comprise at least a third channel communicating with a vacuum generator so as to generate a thermal air convection from the first channel to the third channel along a side of the top film facing the dome-shaped die.

8 Claims, 15 Drawing Sheets

(51) Int. Cl.
*B65B 9/04* (2006.01)
*B65B 11/52* (2006.01)

(56) References Cited

U.S. PATENT DOCUMENTS 3,528,865 A * 9/1970 Amberg ..... B29C 51/10 156/214
3,694,991 A * 10/1972 Perdue ..... B65B 11/52 53/427
3,699,666 A * 10/1972 Calvert ..... B65B 47/02 34/571
3,835,618 A * 9/1974 Perdue ..... B65B 31/02 53/509
3,950,919 A * 4/1976 Perdue ..... B65B 11/52 53/433
4,139,586 A * 2/1979 Gasson ..... B29C 33/046 264/2.7
4,676,049 A * 6/1987 Wallter ..... B65B 9/04 53/433
4,862,671 A * 9/1989 Lanoiselee ..... B65B 7/164 53/167
4,966,546 A * 10/1990 Wu ..... F26B 13/10 432/121
6,408,598 B1 * 6/2002 Stockley, III ..... B65B 31/025 53/427
6,835,348 B2 * 12/2004 Hirosue ..... B29C 51/10 264/544
8,807,983 B2 * 8/2014 Petersson ..... B29C 51/28 425/389
2003/0196412 A1 * 10/2003 Foulke, Jr. ..... B65B 31/028 53/432
2005/0257501 A1 * 11/2005 Natterer ..... B65B 7/164 53/432
2012/0085069 A1 4/2012 Mader
2019/0016489 A1 * 1/2019 Paul ..... B65B 47/10

FOREIGN PATENT DOCUMENTS

DE 102009020898 A1 11/2010
EP 2722281 A2 4/2014
EP 2815983 A1 12/2014
EP 3028837 A1 6/2016
JP 2006044732 A 2/2006
JP 5954700 B2 * 7/2016
WO WO-2007071298 A1 * 6/2007 ..... B65B 47/08
WO 2015091404 A1 6/2015

* cited by examiner

TRAY SEALER

CROSS-REFERENCE TO RELATED APPLICATIONS

This Application claims priority to German Patent Application No. 10 2016 123 569.5, filed on Dec. 6, 2016, to Albert Gabler et al., currently pending, the entire disclosure of which is incorporated herein by reference.

FIELD OF THE INVENTION

The present invention relates to a tray sealer that heats a skinnable top film using air convection.

BACKGROUND OF THE INVENTION

WO 2015091404 A1 discloses a tray sealer for sealing a tray with a skinnable top film. The top film is heated using a dome-shaped plate, which is adapted to be moved relative to a dome-shaped die, and is pulled by the dome-shaped plate itself into the dome-shaped die for forming. The movable and heatable dome-shaped plate involves a high constructional outlay.

EP 2815983 A1 discloses a tray sealer, which, in a similar manner, is configured for heating a skinnable top film by applying it to the heated wall of a dome-shaped die.

SUMMARY OF THE INVENTION

It is the object of the present invention to provide an improved tray sealer for sealing a tray with a skinnable top film. This object may be achieved by a tray sealer for heating a skinnable top film using air convection.

According to the present invention, the tray sealer may include a sealing station comprising a tool upper part, a clamping frame and a tool lower part, wherein the tool upper part may comprise a dome-shaped die for deforming a skinnable top film, wherein the dome-shaped die may comprise at least a second channel establishing, together with a first channel, a direct connection in the tool upper part, wherein the dome-shaped die may have an inner contact surface, and wherein the clamping frame may be configured to clamp the top film in position on the tool upper part in a gas-tight manner so as to define an upper chamber within the tool upper part. "Skinnable" means that, in a heated condition, the top film may be able to flexibly adapt itself to the contour of the product and of the tray and to cling thereto like a skin.

The invention may be characterized in that the tool upper part or the dome-shaped die may comprise at least a third channel as a connection to a vacuum generator so as to generate a thermal air convection from the first channel to the third channel along a side of the top film facing the dome-shaped die. This allows the top film to be heated using heated air without making use of compressed air. Since the top film will not bulge downwards, i.e. in the direction of the tool lower part, during heating using air convection, the stroke of the tool lower part can, especially in the case of very high products, be reduced in comparison with the prior art. Due to an upward pull in the direction of the dome-shaped die, which can be produced by said air convection, the top film may be already prepared in the direction of the subsequent thermoforming and a low negative pressure already prevails in the chamber so as to accelerate the thermoforming process upwards and into the dome-shaped die by a vacuum applied from one side.

Preferably, the dome-shaped die may comprise a plurality of ventilation ducts through which the air, which flows through the dome-shaped die and then into the chamber, takes up the heat of the dome-shaped die and gives off part of said heat while flowing past the top film.

The ventilation ducts open preferably into the second channel, so that they will centrally be supplied with incoming air via the tool upper part and so that, in addition, the chamber can be evacuated via the ventilation ducts during thermoforming. The dome-shaped die occupies in this case an upper position.

Preferably, the ventilation ducts have together an overall aperture area of at least 70 to 150 $mm^2$, so as to provide a sufficient amount of incoming air for air convection and limit in the chamber a negative pressure resulting from air convection.

Preferably, the dome-shaped die may have a lower sealing surface used for sealing the top film onto a tray edge of a tray.

According to a particularly advantageous embodiment, the dome-shaped die may be movable relative to the tool upper part so that, e.g. for carrying out a sealing process, the dome-shaped die can be moved in the direction of the tray or the tool lower part.

The dome-shaped die may be preferably movable between an upper position for deforming the skinnable top film and a lower position for sealing the top film onto the tray edge of at least one tray.

According to a particularly advantageous embodiment, the dome-shaped die may have a plurality of side channels establishing a bypass between the interior and the exterior of the dome-shaped die so as to limit a negative pressure created in the interior of the dome-shaped die. In this way, e.g. an undesired premature contact of the top film with the sealing surface can be avoided.

Preferably, a seal may be provided for or at a transition of the first channel of the dome-shaped die to the second channel of the tool upper part, so as to prevent, at the upper position of the dome-shaped die, spurious air and spurious flows between the tool upper part and the dome-shaped die during the process of top film heating as well as during the thermoforming process.

Preferably, at least a second valve may be provided for the second channel, said valve being configured for optionally switching between a vacuum generator for thermoforming the top film and an opening to the surroundings for allowing air to flow in for the convection process. Likewise, the valve can effect ventilation by opening to the surroundings during the skinning process, where the pressure difference from above and from below the top film brings the skinnable top film into contact with the product and the interior of the tray.

According to another advantageous embodiment, the second valve may be connectable to a blowing device, so as to support the flow-in of air in a controlled or closed-loop control manner, whereby also the negative pressure in the chamber can be influenced.

Preferably, at least a third valve may be provided between the vacuum generator and the third channel of the tool upper part or of the dome-shaped die, so as to allow switching between the thermal air convection for heating the top film and the forming process of the top film.

The method of operating a tray sealer according to the present invention may be carried out using a control unit, the tray sealer including a sealing station, which may comprise a tool upper part, a clamping frame and a tool lower part. The tool upper part surrounds a dome-shaped die used for deforming a skinnable top film and movable relative to the tool upper part. The dome-shaped die may comprise at least a first channel establishing, together with a second channel, a direct connection in the tool upper part, wherein the dome-shaped die may have an inner contact surface, and wherein the clamping frame may be configured to clamp the top film in position on the tool upper part in a gas-tight manner, so as to define a chamber within the tool upper part. The method may be characterized in that, via at least a third channel provided in the dome-shaped die or in the tool upper part and connected to a vacuum generator, thermal air convection may be generated along the side of the top film facing the dome-shaped die, the vacuum generator withdrawing air from the chamber and air that may have been heated by the dome-shaped die flowing in through the connection with the tool upper part, so that heat will be given off to the top film while the heated air passes by. Due to the constant flow-in of heated air, the input of heat in the top film may be maximized and the temperature required for the forming process may be reached within the shortest possible time. This leads to a reduction of the time required for the heating phase and, consequently, to an increase in the performance of the tray sealer.

Preferably, the air convection may be of a pulselike nature, e.g. due to the fact that a third valve may be clocked, thus allowing the negative pressure in the chamber and the flow velocity to be influenced. The heat transfer to the top film may be optimized and a premature contact between the top film and the sealing surface of the dome-shaped die may be avoided.

The pulse spacing ranges preferably from 0.1 s to 0.5 s in order to avoid an unnecessary extension of the heating time.

Preferably, a blowing device may be used for supplying ambient air to the dome-shaped die, so as to accomplish a simple structural design for air convection.

According to a particularly advantageous embodiment, heated air may be supplied to the dome-shaped die using a heating device provided outside the dome-shaped die, so as to reduce the heating time for the skinnable top film prior to thermoforming.

The air may be preferably heated to a temperature of more than 80° C. using the heating device.

Other aspects and advantages of the present invention will be apparent from the following detailed description of the preferred embodiments and the accompanying drawing figures.

DESCRIPTION OF THE SEVERAL VIEWS OF THE DRAWING

In the following, an advantageous embodiment of the present invention will be explained in more detail making reference to a drawing, in which the individual figures show.

DETAILED DESCRIPTION OF THE INVENTION

Figure 1:
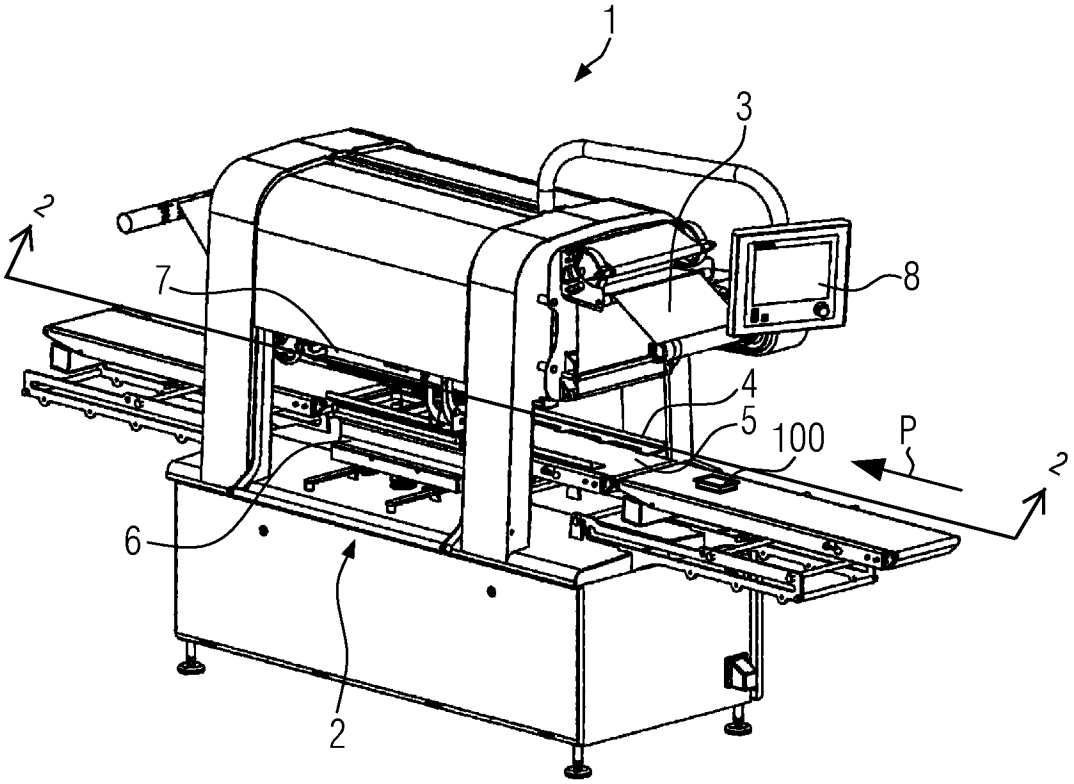
FIG. 1 is a side view of one embodiment of a tray sealer in accordance with the teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a tray sealer 1 comprising a sealing station 2, which seals trays 100 with a top film 3, and a gripper system 4, which moves the trays 100 in a conveying direction P from a feed conveyor 5 into the sealing station 2. The sealing station 2 has a tool lower part 6 and a tool upper part 7 arranged above the latter. A control unit 8 controls and monitors all the processes in the tray sealer 1. The sealing station 2 is provided for sealing a plurality of trays 100. This may take place in the form of multi-row sealing and/or multi-track sealing, multi-row meaning that a plurality of trays 100 are provided in succession in the conveying direction P and multi-track meaning that there are provided two or more trays 100, which are arranged side by side in parallel and orthogonal to the conveying direction P.

Figure 2:
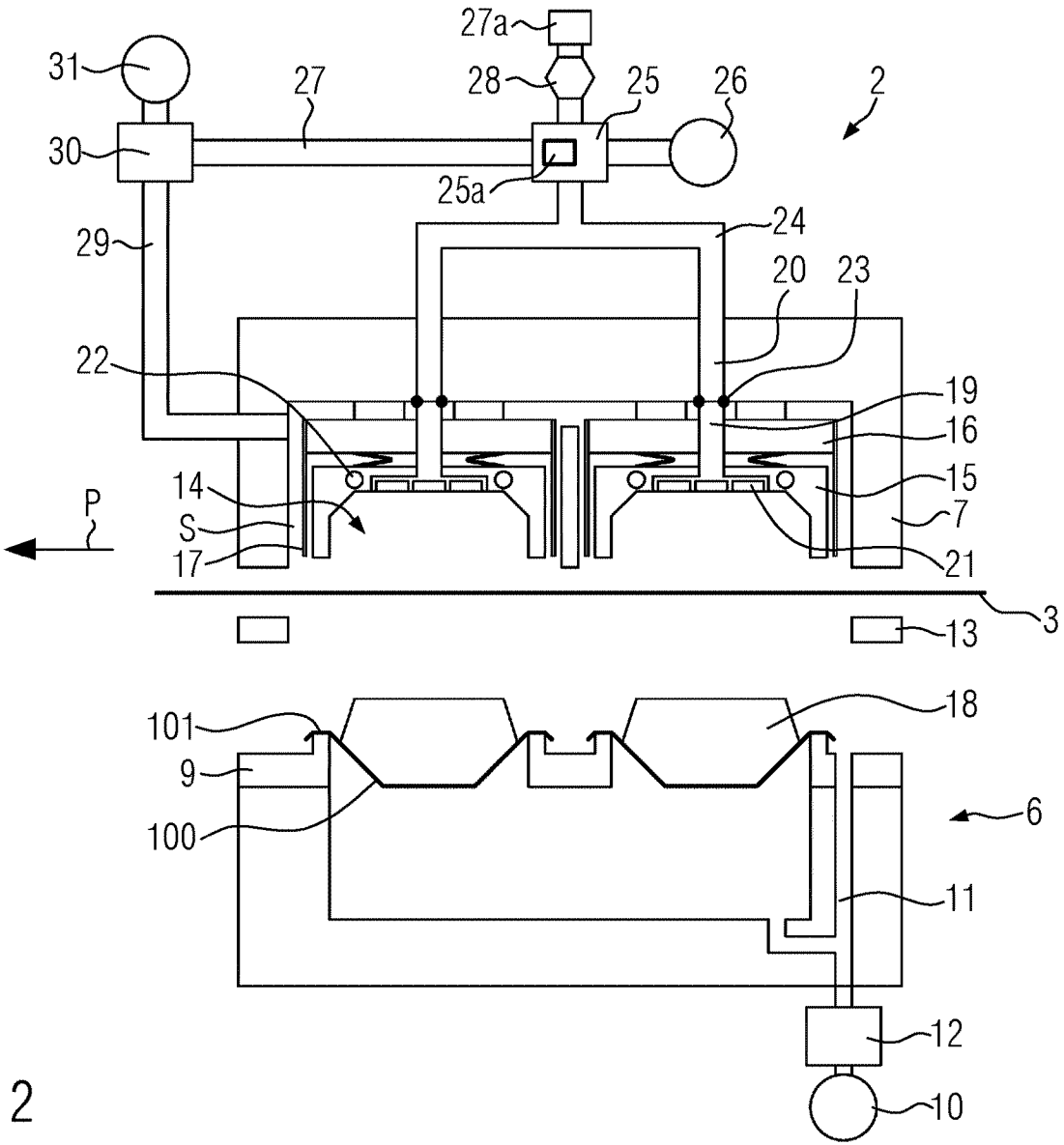
FIG. 2 is a section view of the tray sealer of FIG. 1 cut along the line 2-2 showing the tray sealer at an open position.

FIG. 2 shows a sealing station 2 according to the present invention at an open position, at which the tool lower part 6 is spaced apart from the tool upper part 7 and the top film 3 extends therebetween in the conveying direction P. The tool lower part 6 comprises a tray accommodation unit 9 and is connected via a vacuum line 11 and a first valve 12 to a vacuum generator 10 comprising e.g. a central vacuum unit or a vacuum pump. A clamping frame 13 is provided between the tool lower part 6 and the tool upper part 7, so as to clamp the top film 3 against the tool upper part 7 along the outer circumference of the latter in a gas- and pressure-tight manner, thus defining a chamber 14 between the top film 3 and the tool upper part 7.

The bell-shaped tool upper part 7 receives in the interior thereof a dome-shaped die 15 and a pressure plate 16, the pressure plate 16 having arranged thereon a cutting device 17 for cutting the top film 3 outside the dome-shaped die 15 along a tray edge 101 of the tray 100 around the circumference of the latter. In the tray 100 a product 18 is shown, which projects upwards beyond the tray edge 101.

A first channel 19 penetrates the dome-shaped die 15. Between the first channel 19 and a second channel 20, which penetrates the wall of the bell-shaped tool upper part 7, a fluid connection can be established. Via the two channels 19, 20, air may be supplied to the chamber 14 or removed therefrom. The channel 19 may be configured as a tube and extend through the pressure plate 16 up to or into the tool upper part 7 while the dome-shaped die 15 occupies its upper position. The dome-shaped die 15 comprises ventilation ducts 21 through which air can flow from the first channel 19 through the dome-shaped die 15 into the chamber 14. Since the dome-shaped die 15 is heated using one or a plurality of heating elements 22, also the air will be heated when it flows through the dome-shaped die 15. At the upper position of the dome-shaped die 15 relative to the tool upper part 7, the first channel 19 is connected to the second channel 20 using a seal 23. The second channel 20, in turn, is connected to a second valve 25 via a line 24. At the second valve 25, a vacuum generator 26 comprising e.g. a central vacuum unit or a vacuum pump is provided for thermoforming, making use of the line 24, the skinnable top film 3 into an inner area of the dome-shaped die 15 when a negative pressure is applied. Optionally, also a blowing device 27*a* and/or an air heating device 28 may be provided on the second valve 25. The second valve 25 also has a connection or opening 25*a* communicating with the surroundings, through which air can flow via the second valve 25 into the chamber 14.

The tool upper part 7 is connected via one or a plurality of lines 29 to a third valve 30 through which a vacuum generator 31 can be connected so that an air convection can be generated in chamber 14. This process will be explained in more detail in the figures following hereinafter. The vacuum generator 31 may e.g. be a side-channel compressor, a ring-channel blower or a vacuum source, preferably a vacuum pump. The at least one line 29 opens into chamber 14 at a location where a gap S is defined between the bell-shaped tool upper part 7 and an outer or upper side of the dome-shaped die 15.

Figure 3:
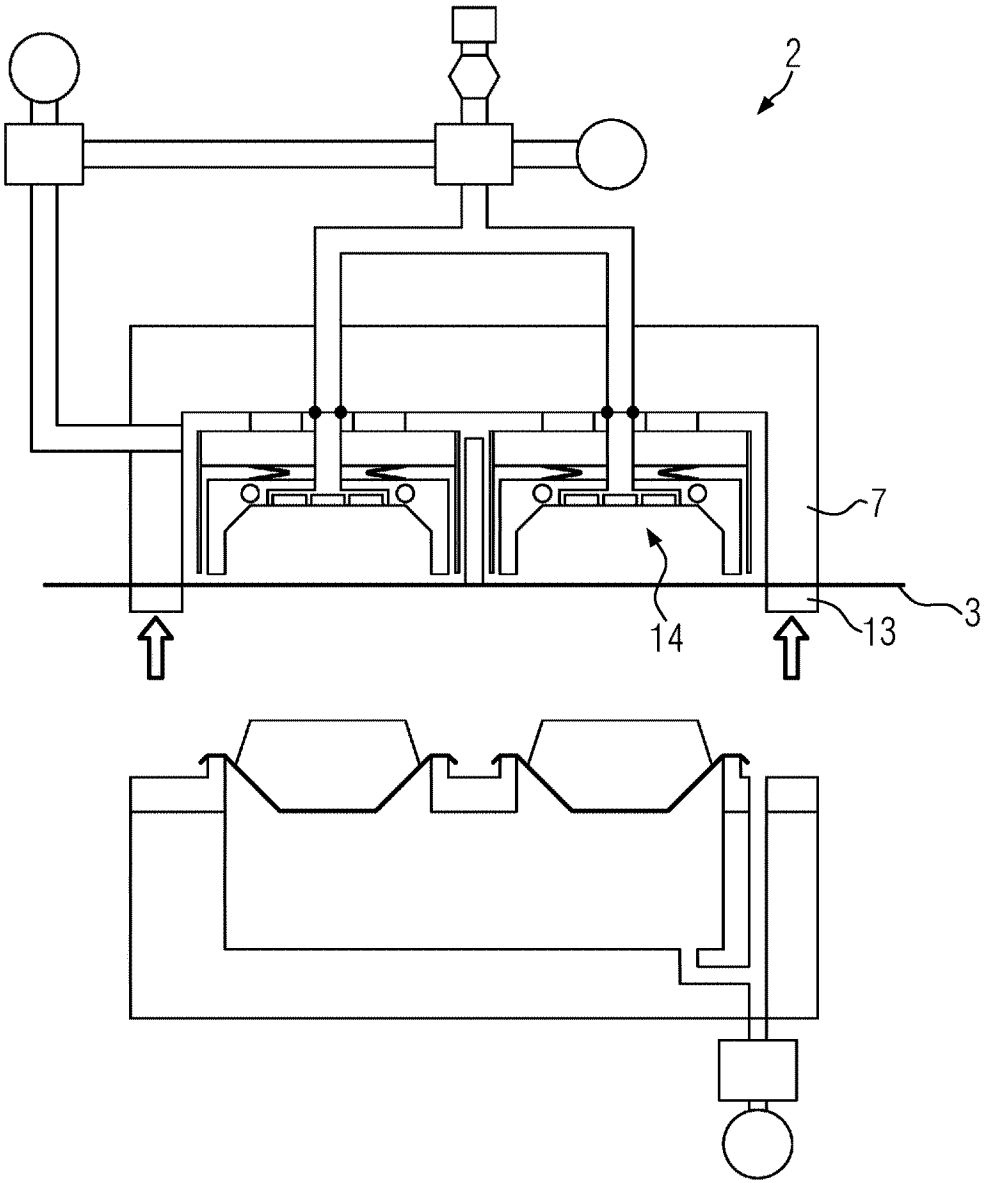
FIG. 3 is a section view of the tray sealer of FIG. 1 cut along the line 2-2 showing the top film clamped in position.

FIG. 3 shows the sealing station 2 with the top film 3 clamped in position. The clamping frame 13 has been lifted upwards onto the tool upper part 7 using a lifting mechanism that is not shown in detail, and clamps now the top film 3 in position on the tool upper part 7 along the circumference of the latter. Thus, the chamber 14 is formed in the interior of the tool upper part 7.

Figure 4A:
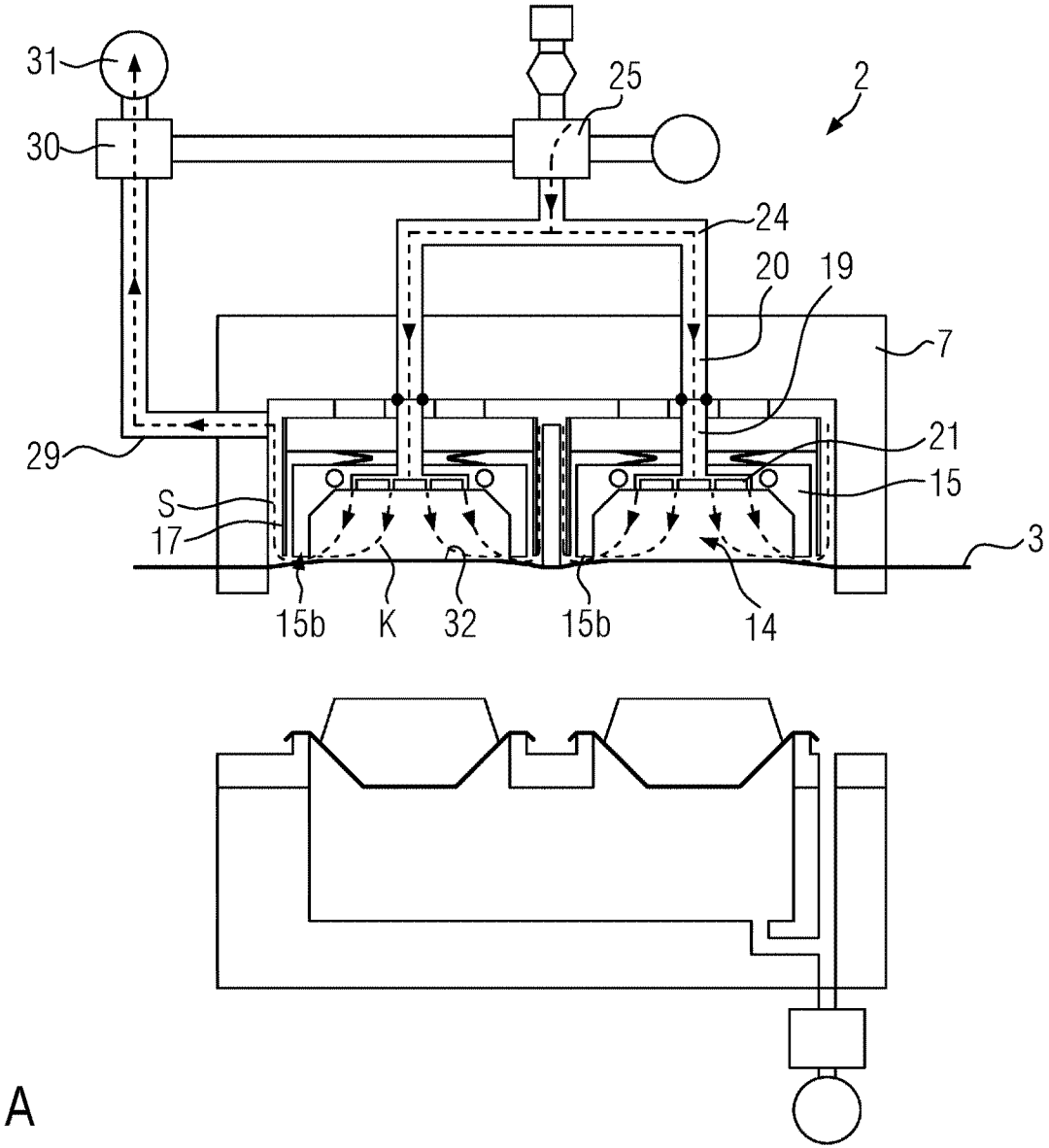
FIG. 4A is a section view of the tray sealer of FIG. 1 cut along the line 2-2 showing heating of the top film.

FIG. 4A shows the sealing station 2 during heating of the top film 3, preferably a skinnable top film, which, prior to a thermoforming process upwards into the dome-shaped die 15, is heated to a temperature of e.g. 80° C. to 200° C., so as to prevent damage to the top film 3 during the subsequent thermoforming process. The process of heating the top film 3 will be described in more detail hereinafter.

The third valve 30 connects the vacuum generator 31 through to line 29 in order to generate a negative pressure in chamber 14. The second valve 25 establishes via line 24 a connection of the second channel 20 to the ambient air, so that air can continue to flow via the first channel 19 and the ventilation ducts 21 through the heated and thus warmed-up dome-shaped die 15 into the chamber 14. The air convection K thus created, cf. the arrows shown, takes place along the upper surface 32 of the top film 3, which faces the dome-shaped die 15, and gives off heat to the top film 3. Continuing its flow, the air flows below lower edges (sealing surfaces) 15*b* of the dome-shaped die 15 outwards, out of the interior of the dome-shaped die 15, and then past the cutting devices 17 out of the tool upper part 7 to the vacuum generator 31. The existing negative pressure can have the effect that the top film 3 is extended upwards in the direction of the dome-shaped die 15, preferably when a heat input in the top film 3 has already taken place. In this respect, it may be of advantage to switch the third valve 30 e.g. with a cycle time of 0.1 s to 0.5 s so as to prevent, before the temperature required for thermoforming has been reached in the top film 3, excessive extension and thus a contact with a sealing surface 15*b* that is not yet desired at this moment in time.

Figure 4B:
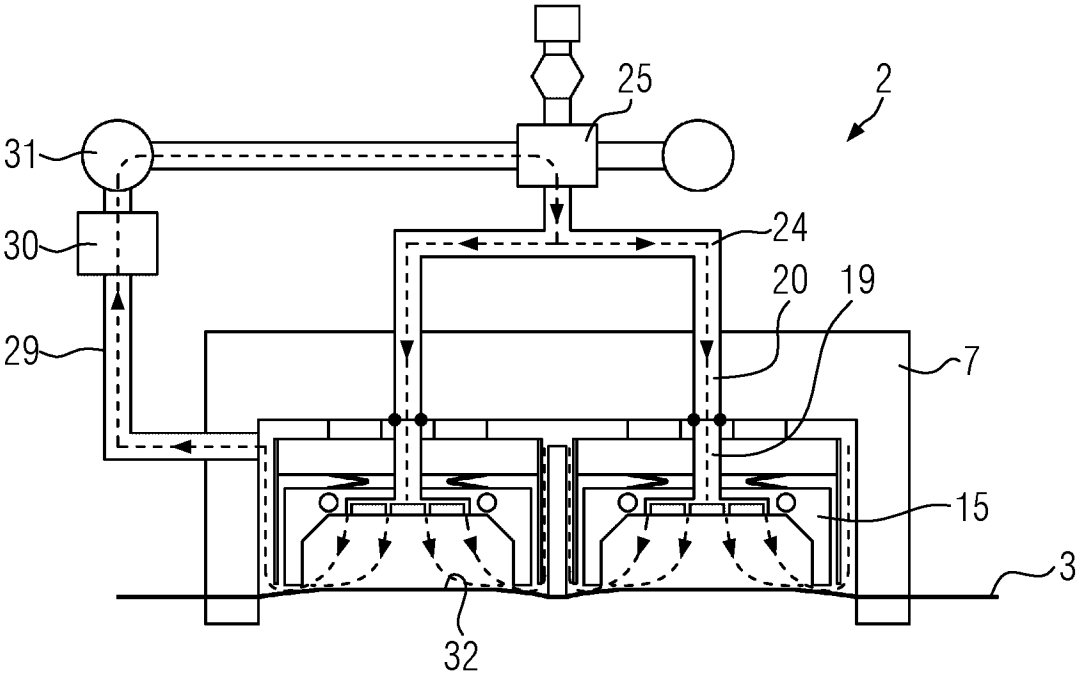
FIG. 4B is a section view of the tray sealer of FIG. 1 cut along the line 2-2 showing the tool upper part during heating of the top film in an alternative embodiment.

As shown in FIG. 4B on the basis of the tool upper part 7, it is also conceivable that, when the vacuum generator 31 is configured as a side-channel compressor or as a ring-channel blower, the air flows in a closed circuit from the vacuum generator 31 via the second valve 25, the first channel 19, the second channel 20, the lines 24 through the dome-shaped die 15 past the top film 3 and continues to flow through line 29 from the tool upper part 7 to the third valve 30 and to the vacuum generator 31.

Figure 5:
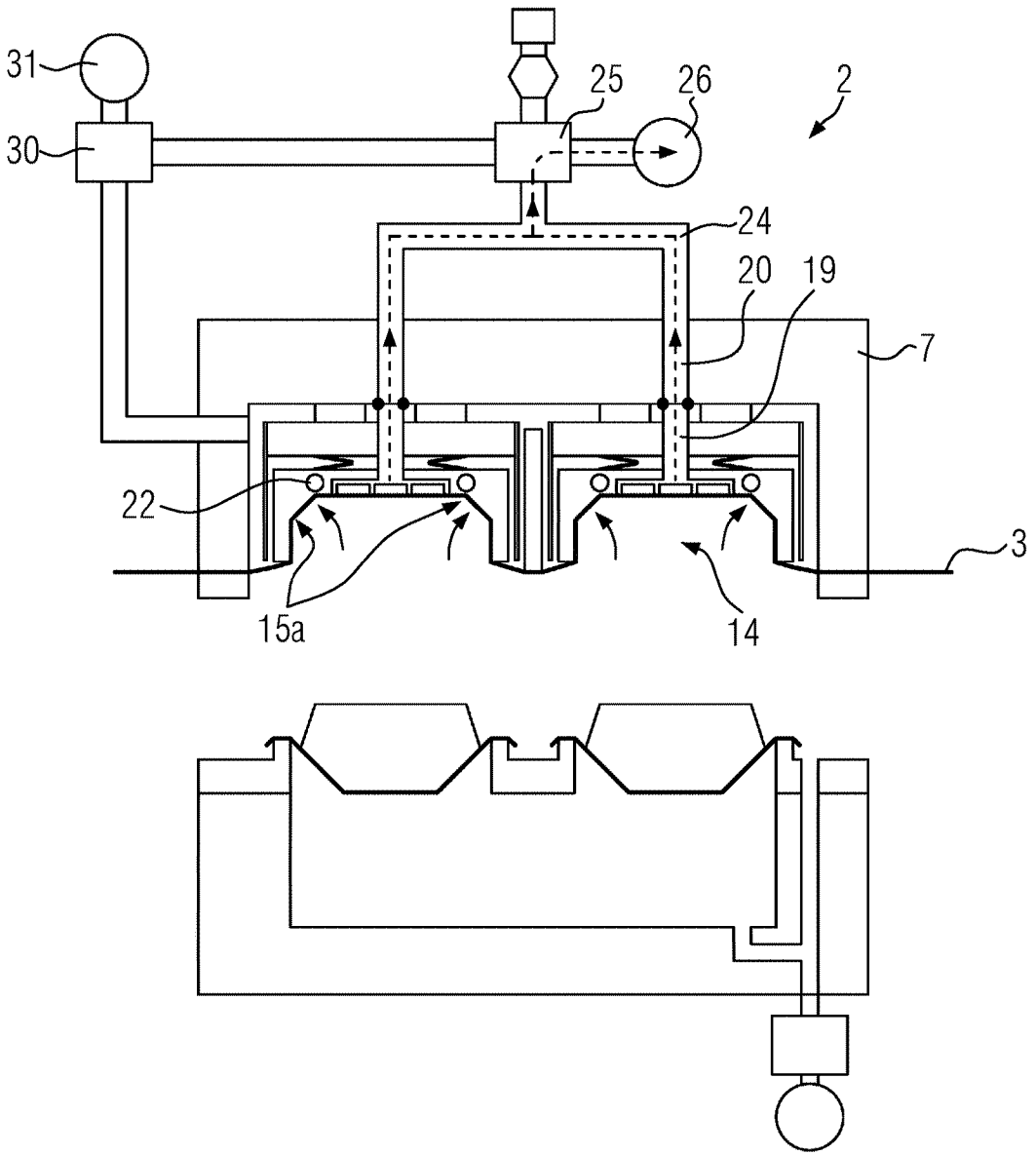
FIG. 5 is a section view of the tray sealer of FIG. 1 cut along the line 2-2 showing the top film in a deformed condition.

FIG. 5 shows the sealing station 2, with the top film 3 in a deformed condition. At the beginning of the thermoforming process, the third valve 30 will shut off the vacuum generator 31 against the tool upper part 7 and consequently also against the chamber 14. At the same time, a short time before or immediately afterwards, the second valve 25 connects the line 24 for the first channel 19 and also for the second channel 20 to the vacuum generator 26, so that chamber 14 will be evacuated and the top film 3 will be thermoformed and expanded upwards into the interior, the so-called dome, of all dome-shaped dies 15. In the course of this process, the top film 3 is heated still further due to the fact that it is in contact with the inner contact surface 15*a* of the dome-shaped die 15. The temperature of the dome-shaped die 15 is closed-loop controlled or controlled using the control unit 8 by controlling the heating elements 22 and at least one temperature sensor, which is not shown in detail.

Figure 6:
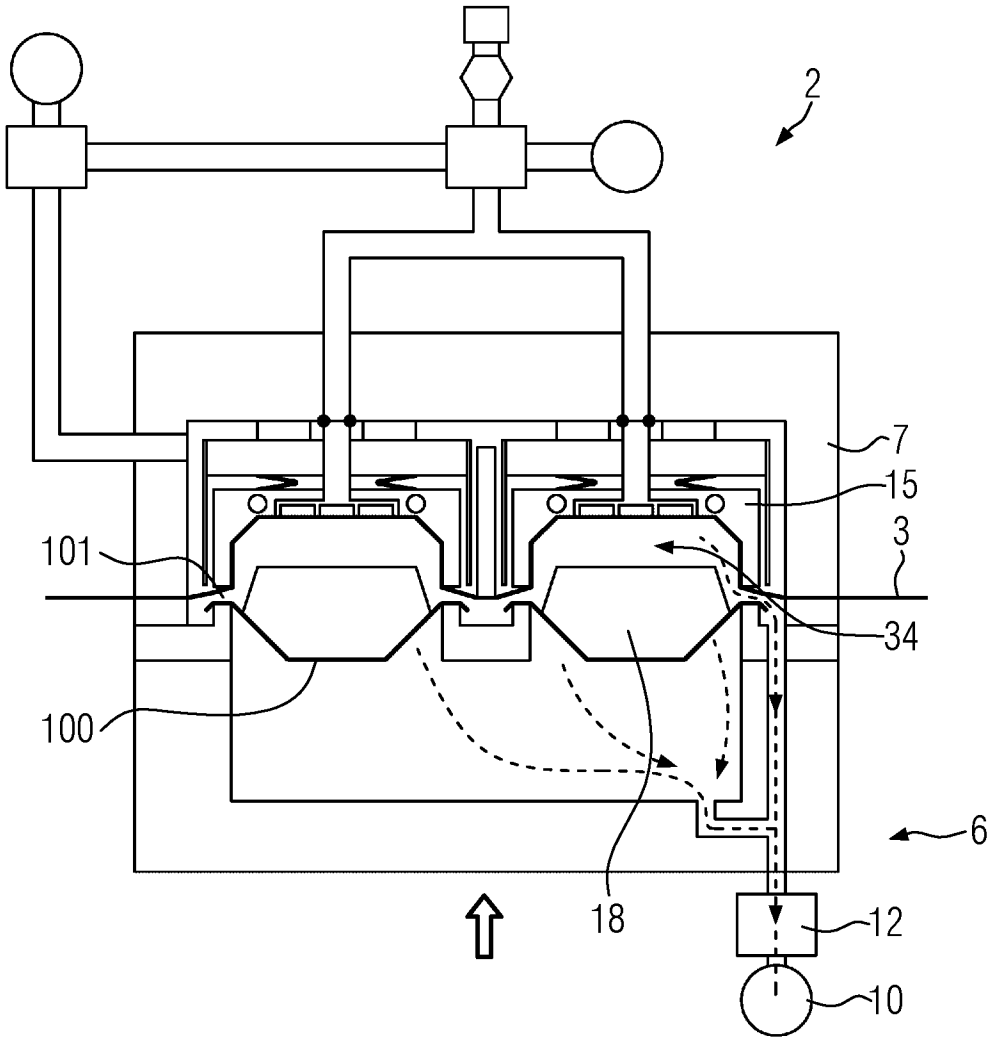
FIG. 6 is a section view of the tray sealer of FIG. 1 cut along the line 2-2 showing the tray sealer at a closed position.

FIG. 6 shows the sealing station 2 at its closed position after the tool lower part 6 with the tray accommodation unit 9 and the trays 100 contained therein has been moved, using a lifting mechanism that is not shown in detail, upwards onto the tool upper part 7 simultaneously with, a short time before or immediately after the forming process, and a second chamber 34 has been formed between the top film 3 and the trays 100 with the products 18 contained therein. Due to the upwardly deformed top film 3, products 18 projecting upwards beyond the tray edge 101 will be allowed to enter or project into the interior of the dome-shaped dies 15.

The second chamber 34 is evacuated via the vacuum generator 10 connected using the switched first valve 12. Simultaneously, the vacuum in the dome-shaped die 15 holds the top film 3 in position until a desired vacuum value has been reached in the second chamber 34 and consequently also around the product 18.

Figure 7:
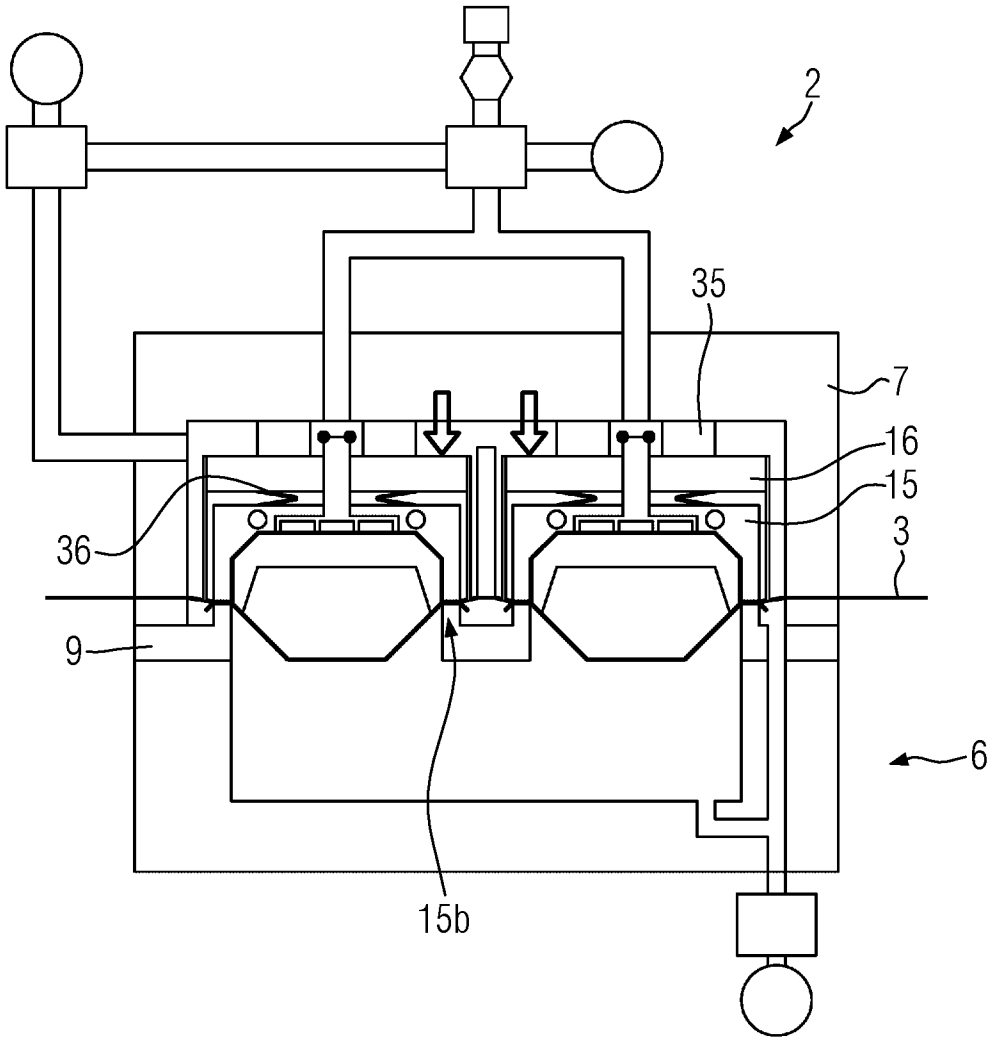
FIG. 7 is a section view of the tray sealer of FIG. 1 cut along the line 2-2 showing the tray sealer during the sealing process.

FIG. 7 shows the sealing station 2 during the process of sealing the top film 3 onto the tray edge 101. To this end, the pressure plate 16, together with the dome-shaped die 15, is moved using lifting mechanisms 35 downwards onto the tool lower part 6 and the tray accommodation unit 9, respectively, to a lower position. During the sealing process, the dome-shaped die 15 presses with its heated lower sealing surface 15*b* the top film 3 against the tray edge 101 with a pressure generated via a spring device 36 between the pressure plate 16 and the dome-shaped die 15, so as to establish a gas-tight connection between the top film 3 and the tray 100. At the beginning of the sealing process, the skinnable top film 3 is preferably still held at a position of contact in the interior of the dome-shaped die 15.

Figure 8:
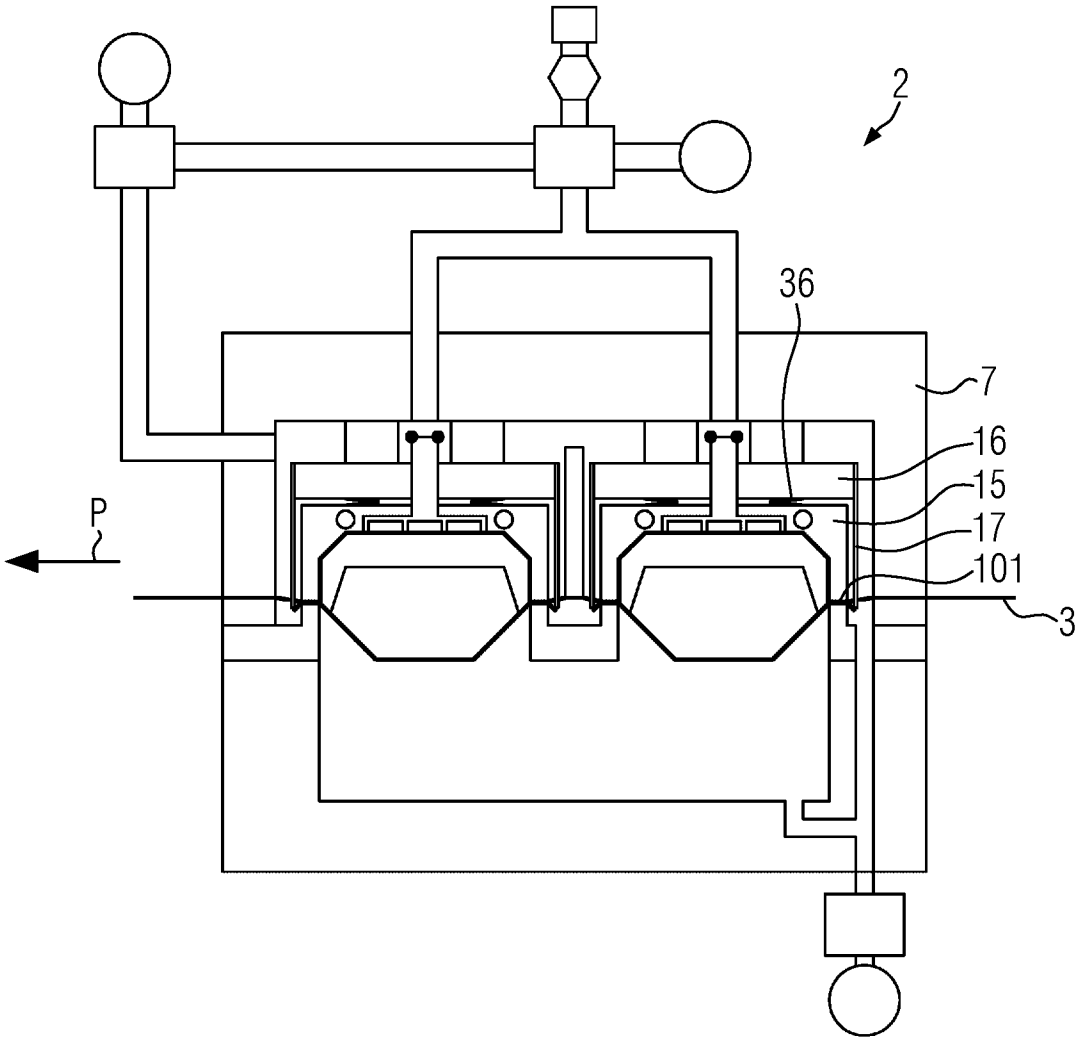
FIG. 8 is a section view of the tray sealer of FIG. 1 cut along the line 2-2 showing the cutting process.

FIG. 8 shows the sealing station 2 during the process of cutting the top film 3 around the dome-shaped die 15, the cutting device 17, e.g. together with the pressure plate 16, being moved further down. During this movement, the pressure applied by the dome-shaped die 15 to the tray edge 101 may increase to different degrees, depending on the structural design of the spring device 36. After the cutting process, openings remain in the top film 3, the so-called residual film grid, which, after the sealing station 2 has been opened, is advanced in the conveying direction P and wound up.

Figure 9:
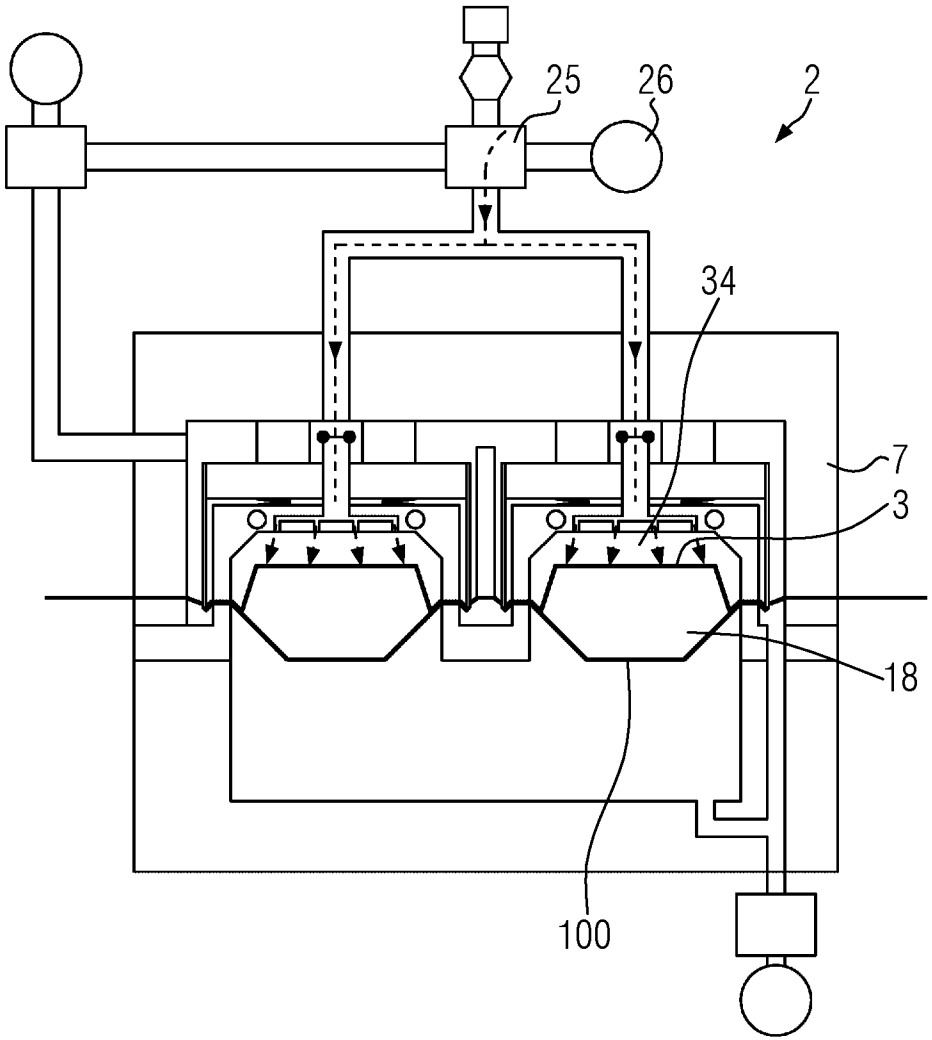
FIG. 9 is a section view of the tray sealer of FIG. 1 cut along the line 2-2 during application of the top film to the product and the tray.

FIG. 9 shows the sealing station 2 during application of the skinnable top film 3 to the product 18 and the tray 100, the so-called skinning process. The property "skinnable" means that the top film 3 is able to flexibly adapt itself, in a heated condition, to the contour of the product 18 and of the tray 100 and cling thereto like a skin. The product 18 is thus held in the tray 100 and an adherent connection is established between the top film 3 and the inner sides of the tray 100, said connection being influenced by the coating of the top film 3 on the side facing the tray 100. The skinning process is supported by the negative pressure prevailing in the second chamber 34 and the ventilation of the first chamber 14, in that the second valve 25 shuts off against the vacuum generator 26 and opens towards the surroundings, so that, due to the existing pressure difference, the top film 3 will abruptly be pushed from above out of the dome-shaped die 15 downwards onto the product 18 and the tray 100.

Figure 10:
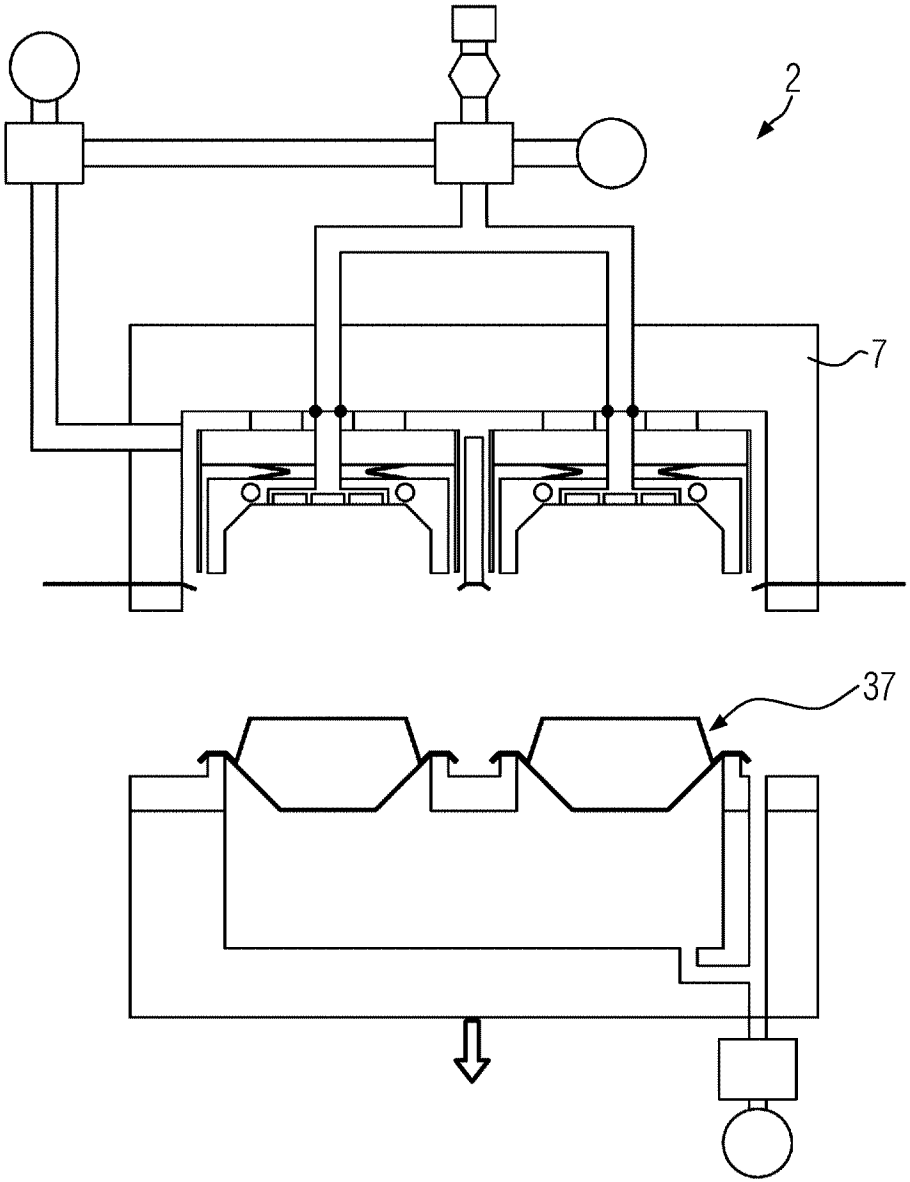
FIG. 10 is a section view of the tray sealer of FIG. 1 cut along the line 2-2 showing another embodiment of the tray sealer in an open position.

FIG. 10 shows the sealing station 2, now again at an open position, with the sealed packages 37.

Figure 11:
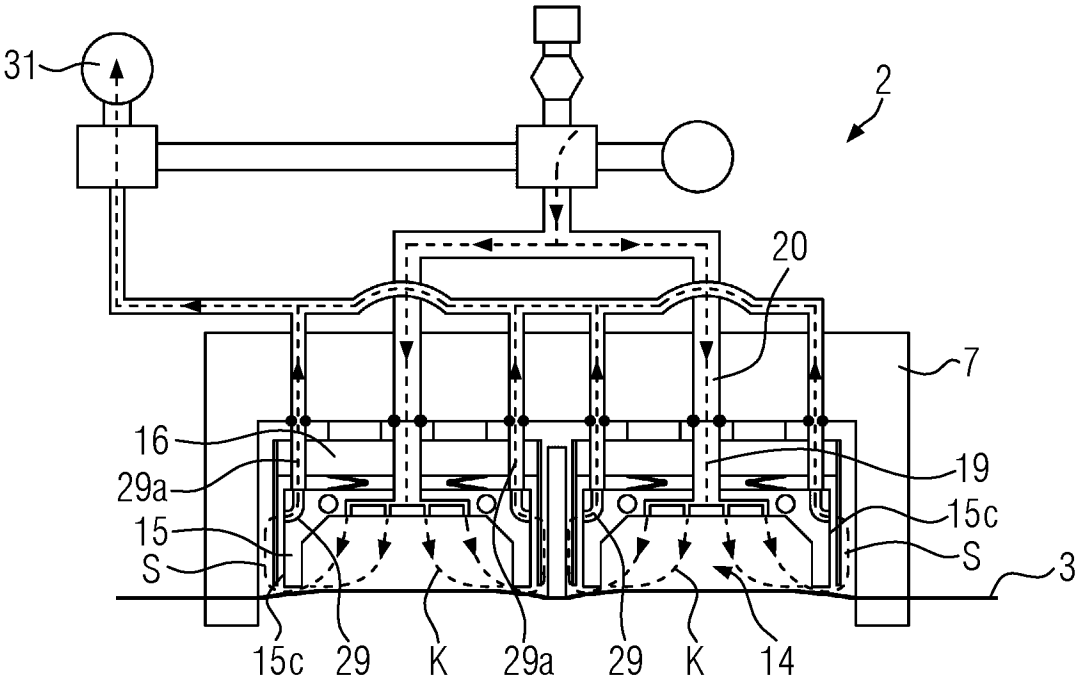
FIG. 11 is a section view of the tray sealer of FIG. 1 cut along the line 2-2 showing another embodiment.

FIG. 11 shows a first alternative embodiment of the sealing station 2 and of the tool upper part 7, where the process of sucking air from chamber 14 does not take place directly via the tool upper part 7. Instead of the line 29 terminating into chamber 14 at the inner side of the tool upper part 7, an extension 29*a* is provided, with which the line 29 continues through the pressure plate 16 and the dome-shaped die 15 and finally opens into the chamber 14 at an outer side 15*c* of the dome-shaped die 15. However, in conformity with the first embodiment, the ends of line 29, configured in the faun of a manifold, again terminate at locations where a gap S is defined between the inner side of the bell-shaped tool upper part 7 and the outer side 15*c* of the dome-shaped die 15. Like in the case of the variant shown in FIG. 4A, the air flows from the surroundings via the first channel 19, the second channel 20 and the dome-shaped die 15 into chamber 14, the flow pattern K, cf. the arrows, in the area of the top film 3 being approximately identical with the flow pattern according to FIG. 4.

Figure 12:
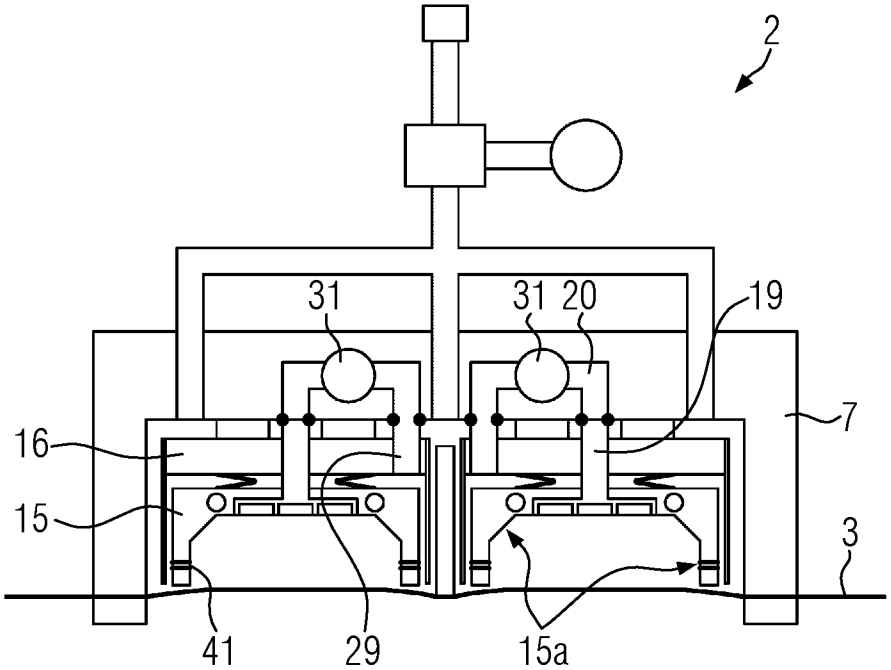
FIG. 12 is a section view of the tray sealer of FIG. 1 cut along the line 2-2 showing another embodiment.

FIG. 12 shows a second alternative embodiment of the sealing station 2 and of the tool upper part 7, in the case of which the air circulates within the dome-shaped die upper part 7. The third channel 29 is provided in the pressure plate 16, whereas the first channel 19 does not extend to the outside but extends again into the interior of the tool upper part 7. The dome-shaped die 15 comprises a plurality of side channels 41 so as to limit the pull of the top film 3 in an upward direction in order to prevent a contact between the top film 3 and the sealing surface 15*b* during heating through air convection K. The side channels 41 are imaginable in the case of all the sealing station variants shown. The vacuum generator 31 is a ring-channel blower in the present embodiment.

Figure 13:
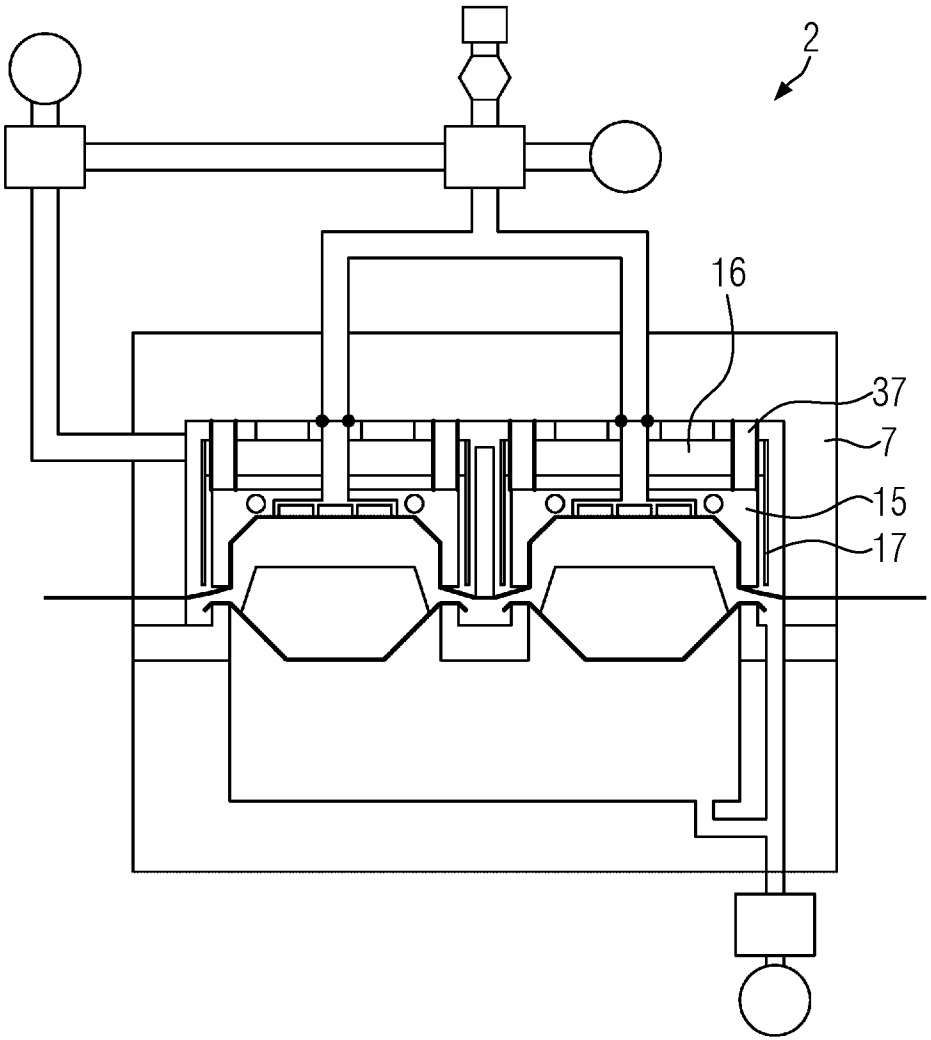
FIG. 13 is a section view of the tray sealer of FIG. 1 cut along the line 2-2 showing another embodiment of the tray sealer in a closed position.

FIG. 13 shows an alternative sealing station 2 at a closed position. Other than in the embodiment of the preceding figures, the dome-shaped die 15 is statically arranged on the tool upper part 7 using guide pins 37 and the cutting device 17 is movable downwards via the pressure plate 16 so as to cut the top film 3.

Figure 14:
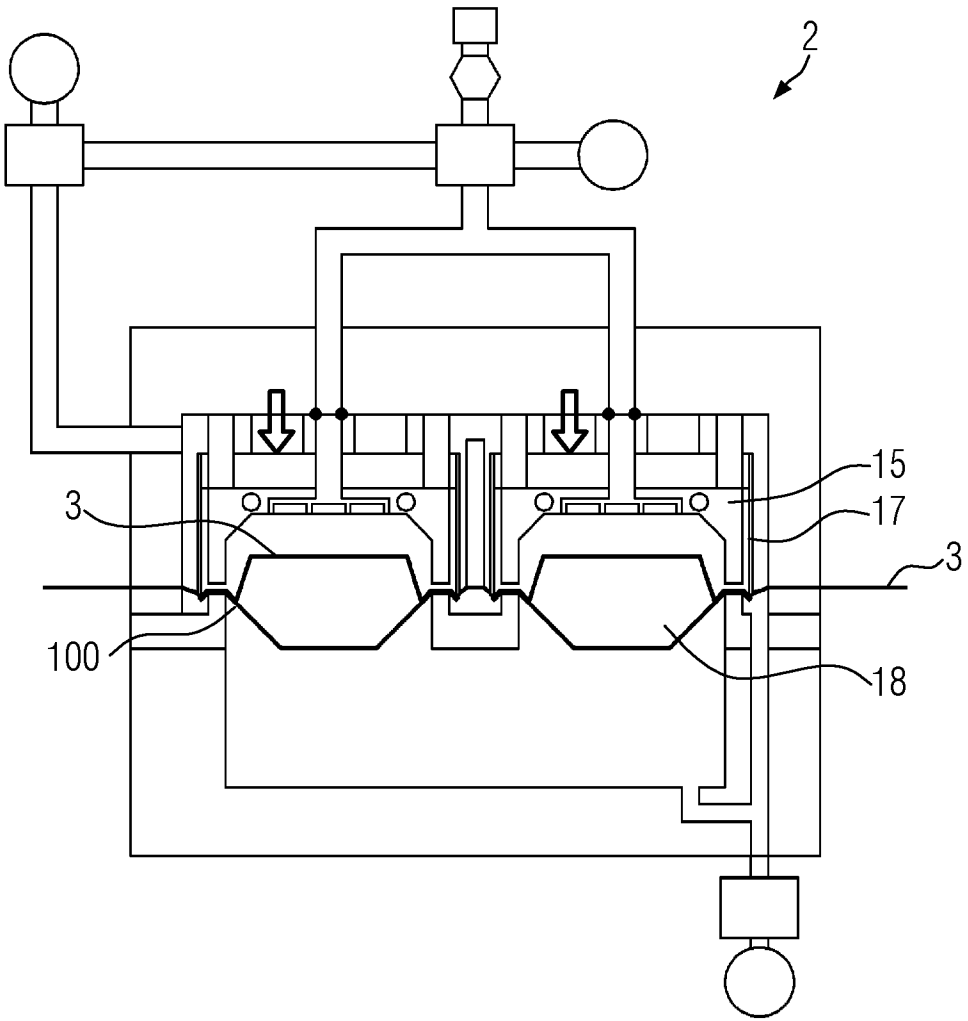
FIG. 14 is a section view of the tray sealer of FIG. 1 cut along the line 2-2 showing another embodiment of the tray sealer after the application of the top film to the product and the tray.

FIG. 14 shows the alternative sealing station 2 after the application of the top film 3 to the product 18 and the tray 100 and shows the cutting device 17 at a lower position, at which the top film 3 has been cut around the circumference of the dome-shaped die 15, so that singular, closed packages were obtained.

The present invention is also suitable for skinning and sealing products 18, which do not project beyond the tray edge 101, with a top film 3.

The control unit 8 controls all the processes and thus also all the lifting mechanisms, adjustment drives, valves and heating elements as well as units, such as vacuum or negative pressure generators.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method of operating a tray sealer, the method comprising the steps of:

providing a tray sealer that includes a control unit and a sealing station, the sealing station comprising a tool upper part, a clamping frame and a tool lower part;

receiving a dome-shaped die in the tool upper part;

deforming a skinnable top film using the dome-shaped die, wherein the dome-shaped die comprises at least a first channel that is in fluid communication with a second channel in the tool upper part, wherein the dome-shaped die has an inner contact surface that defines a cavity;

clamping the top film in position on the tool upper part in a gas-tight manner using the clamping frame to define a chamber within the tool upper part;

withdrawing air from the chamber out of at least a third channel defined in the tool upper part and in fluid communication with the chamber using a vacuum generator that is in fluid communication with the third channel;

introducing a volume of air into the cavity through the first channel of the dome-shaped die and the second channel of the tool upper part using the vacuum generator;

heating the volume of air introduced into the cavity using the dome-shaped die prior to the volume of air being introduced into the cavity; and generating a thermal air flow along a side of the top film facing the dome-shaped die so that heat from the heated air will be given off to the top film while the heated air passes by the top film, wherein the introducing the volume of air into the cavity through the first channel of the dome-shaped die occurs simultaneously with the withdrawing air from the chamber out of at least the third channel step; and wherein the generating the thermal air flow along the side of the top film facing the dome-shape die further comprises the thermal air flow being introduced in the cavity, passing between the film and at least one lower edge of the dome-shaped die, through a gap defined between the tool upper part and the dome-shaped die, and out of the chamber through the third channel.

2. The method according to claim 1, wherein the generating the thermal air flow comprises providing an air flow having a pulse-like nature by clocking the operation of a third valve disposed between the dome-shaped die and the vacuum generator, in a defined series of time intervals.

3. The method according to claim 2, wherein the defined series of time intervals is a cycle time in a range between 0.1 seconds and 0.5 seconds.

4. The method according to claim 1, further comprising supplying ambient air to the dome-shaped die using a blowing device.

5. The method according to claim 1, further comprising supplying heated air to the dome-shaped die using a heating device provided outside the dome-shaped die in addition to the heating the volume of air introduced into the cavity using the dome-shaped die.

6. The method according to claim 1, further comprising a step of regulating a flow of air into or out of the cavity using a second valve on the second channel, the second valve being selectively moveable between a first position and a second position, wherein in the first position, the cavity is in fluid communication with the vacuum generator, and in the second position, the cavity is in fluid communication wither an opening to a surrounding environment.

7. The method according to claim 1, further comprising a step of preventing contact between the film and a sealing surface of the dome-shaped die during the generating the thermal air flow along the side of the top film using a plurality of side channels disposed through the dome shaped die between the inner contact surface and an outer side of the dome-shaped die that faces away from the inner contact.

8. A method of operating a tray sealer, the method comprising the steps of:

providing a tray sealer that includes a control unit and a sealing station, the sealing station comprising a tool upper part, a clamping frame and a tool lower part;

receiving a dome-shaped die in the tool upper part;

deforming a top film using the dome-shaped die, wherein the dome-shaped die comprises at least a first channel that is in fluid communication with a second channel in the tool upper part, and wherein the dome-shaped die has an inner contact surface that defines a cavity;

clamping the top film in position on the tool upper part in a gas-tight manner using the clamping frame to define a chamber within the tool upper part;

introducing a first volume of air into the cavity, wherein the introduced first volume air enters the cavity through the second channel of the tool upper part and the first channel of the dome-shaped die;

heating the first volume of air introduced into the cavity using the dome-shaped die prior to the introducing the first volume of air into the cavity so that the heated first volume of air will heat the top film as the heated air contacts the top film; and generating a thermal air flow along a side of the top film facing the cavity of the dome-shaped die by withdrawing a second volume of air from the chamber through a third channel defined in the tool upper part and in fluid communication with the chamber and and a vacuum generator using the vacuum generator simultaneously with the introducing the first volume of air into the chamber, wherein the first volume of air enters the cavity through the first channel and the second volume of air exits the cavity, passes between the film and at least one lower edge of the dome-shaped die, through a gap defined between the tool upper part and the dome-shaped die and out of the chamber through at least the third channel.

* * * * *